US005188554A

United States Patent [19]

Snellgrove et al.

[11] Patent Number: 5,188,554

[45] Date of Patent: Feb. 23, 1993

[54] METHOD FOR ISOLATING ARC LAMP LEAD-IN FROM FRIT SEAL

[75] Inventors: Richard A. Snellgrove, Danvers; Elliot F. Wyner, Peabody, both of Mass.

[73] Assignee: GTE Products Corporation, Danvers, Mass.

[21] Appl. No.: 453,337

[22] Filed: Dec. 19, 1989

Related U.S. Application Data

[62] Division of Ser. No. 194,060, May 13, 1988, abandoned.

[51] Int. Cl.[5] ..... H01J 9/26

[52] U.S. Cl. ..... 445/26; 445/43

[58] Field of Search ..... 445/26, 43

[56] References Cited

U.S. PATENT DOCUMENTS

| | | | |
|---|---|---|---|
| 3,564,328 | 2/1971 | Bagley | 313/220 |
| 3,866,280 | 2/1975 | Barakitis | 445/26 |
| 3,986,236 | 10/1976 | Barakitis et al. | 445/26 |
| 4,011,480 | 3/1977 | Jacobs et al. | 313/285 |
| 4,208,605 | 6/1980 | McVey et al. | 313/221 |
| 4,409,517 | 10/1983 | Van Der Sande | 313/634 |
| 4,501,799 | 2/1985 | Driessen et al. | 313/636 |
| 4,545,799 | 10/1985 | Rhodes et al. | 313/623 |
| 4,585,972 | 4/1986 | Hing | 313/624 |
| 4,687,969 | 8/1987 | Kajihara et al. | 445/26 |
| 4,694,219 | 9/1987 | Hing | 313/624 |
| 4,704,093 | 11/1987 | Morris | 445/26 |
| 4,713,580 | 12/1987 | Schoene | 313/624 |
| 4,746,316 | 5/1988 | Sudo et al. | 445/43 |

FOREIGN PATENT DOCUMENTS

| | | | |
|---|---|---|---|
| 0136505 | 4/1985 | European Pat. Off. | 61/36 |
| 7629233 | 7/1987 | France | 61/36 |
| 163734 | 9/1984 | Japan | 445/26 |

OTHER PUBLICATIONS

Patent Abstracts of Japan, vol. 2, No. 47, Jan. 14, 1978, JP-A-53 4384 (Hitachi Seisakusho).

Patent Abstracts of Japan, vol. 10, No. 293 (E-443) (2349) Oct. 4, 1986, and JP-A-61 110932 (Toshiba Corp.), May 29, 1986.

European Search Report published Feb. 4, 1991 for European Patent Application No. 89 108 640.7.

*Primary Examiner*—Kenneth J. Ramsey

*Attorney, Agent, or Firm*—R. E. Walter

[57] ABSTRACT

An arc tube for a high pressure metal vapor discharge lamp is provided. The arc tube of the present invention comprises a tubular ceramic envelope; a chemical fill within said envelope; a seal button at each end of said envelope; said seal button having an aperture therethrough for receiving a feedthrough member; a feedthrough member having an electrode projecting therefrom passing through said seal button aperture and being oriented such that the electrode projects into said tubular ceramic envelope, said feedthrough member being sealed into said seal button by means of a fritless seal between said seal button and said feedthrough; and sealing frit material sealing said seal buttons into the ends of said tubular ceramic envelope. A method for fabricating the above-described arc tube and high pressure metal vapor discharge lamp including the above-described arc tube is also provided.

1 Claim, 3 Drawing Sheets

METHOD FOR ISOLATING ARC LAMP LEAD-IN FROM FRIT SEAL

This is a division of copending application Ser. No. 07/194,060, filed on May 13, 1988, now abandoned.

TECHNICAL FIELD OF THE INVENTION

The present invention relates to arc tubes, and more particularly to arc tubes used in high pressure metal vapor discharge lamps.

BACKGROUND OF THE INVENTION

The arc tube for a high pressure sodium (HPS) lamp typically comprises a translucent polycrystalline alumina (PCA) or yttria tubular envelope sealed at either end with a ceramic button fabricated from a similar material. Passing through this button is a feedthrough member (also referred to herein as "inlead") comprising niobium. The feedthrough member may be in the form of a tube or a wire. The feedthrough member may further comprise other metal additives such as, for example, zirconium. The feedthrough member performs the function of electrical inlead and electrode support. The end structure of the arc tube is hermetically sealed by means of a frit material. Frit materials typically comprise oxides of calcium and alumina. Frit materials may further include oxides of barium, magnesium, boron, strontium, beryllium, and/or yttrium.

Arc tubes typically are constructed in one of three conventional designs: the monolithic design, the hat design, or the disk design. Examples of these three conventional designs are described and illustrated in U.S. Pat. No. 4,713,580 issued to Schoene, which patent is hereby incorporated herein, to the extent necessary, by reference.

The frit material used to form seals in the arc tube of a high pressure metal vapor discharge lamp must have a composition which does not react with the components of the fill gas. Additionally, the thermal expansion properties of the frit material should be within certain tolerances of those of the materials used to form the envelope, seal button, and feedthrough member so that the seal formed will not crack upon thermal cycling. For practical reasons during sealing, it is desirable to minimize the melting point of the frit sealing material.

High pressure metal vapor discharge lamps of the high pressure sodium type operate at seal temperatures of about 700° C. Although such lamp has very high luminous efficiency, the color of the light output is not satisfactory for many applications. Thus, there is a need to improve the color of such HPS lamps.

Because of the low color rendering index (CRI) and color temperature of HPS lamps, much research effort has been directed to improving the color of the lamp light output. One technique for improving color has been to increase the sodium pressure of the lamp which has the effect of increasing the overall CRI. Examples of this technology for lamps with a CRI of about 60 are described by Bhalla (J. Illuminating Engineering Society, Vol. 8, pp 202-206 (1979)). These lamps only increase the correlated color temperature of sodium lamps from about 2100° K. to about 2250° K. This small improvement in color temperature has not been of sufficient magnitude to compensate for other disadvantages associated with this technique. Thus, the resulting lamp has not been well received in the market.

Another approach has been to raise the sodium pressure still further, which raises color temperature to about 2700° K., but the drop in efficacy for such a lamp is precipitous. To increase sodium pressure, the seal temperature must be increased. Sealing frit materials developed for this purpose are described in U.S. Pat. No. 4,501,799. These frit materials have melting temperatures in excess of 1600° C. Such temperatures are much greater than those of conventional sealing frit materials which have melting temperatures of about 1250° C. Further, the rare earth elements included in these frit materials cause these frit materials to be more costly than standard frit materials which include alkaline earth oxide components.

U.S. Pat. No. 4,409,517 issued to Van Der Sande et al. describes achieving improved color in discharge lamps employing ceramic arc tubes which include metal halide fills. To avoid the reaction of the halide components of the fill with the niobium feedthrough, Van Der Sande et al. teach applying a halide resistant coating to that portion of one of the upper inleads which is in contact with the lamp fill. The coating protects the inlead from reaction with the halide vapors.

Another technique for improving the color of high pressure sodium discharge lamps is to include additional radiating elements in the fill. This technique was originally described in U.S. Pat. No. 3,521,108 issued to Hanneman. These lamps typically operate with seal temperatures about 1000° C. Such lamps often experience premature failure.

One of the reasons for failure of high pressure metal vapor discharge lamps of the high pressure sodium type is believed to be caused by reaction between the frit material and the sodium component of the lamp fill. Complete elimination of sealing frit material from the arc tube assembly of such type of lamp is disclosed as a solution to this problem. See U.S. Pat. No. 4,545,799, of Rhodes et al. This patent describes assembling an arc tube envelope made from unsintered, compressed ceramic powder, an insert made from unsintered, compressed ceramic powder, and inlead, and sintering the assembly in a single step without interposition of any frit whatsoever. Such a process requires both the electrodes be inserted through the feedthrough and welded thereto and the fill be added through the hollow inlead after the sintering operation. Neither of these fabrication constraints is desirable.

SUMMARY OF THE INVENTION

In accordance with the present invention, it has been found that the performance of arc tubes used in high pressure metal vapor discharge lamps is improved by creating an interruption, or break in the continuity of, the seal interface between the feedthrough member and the frit material around the total circumference of at least a portion of the feedthrough member. This interruption of the feedthrough member/frit interface inhibits, and advantageously prevents, formation of a continuous path through which fill gas contained in the arc tube can escape from the arc tube.

In accordance with one aspect of the present invention, there is provided an arc tube for a high pressure metal vapor discharge lamp. The arc tube of the present invention comprises a tubular ceramic envelope, a chemical fill within said envelope; a seal button at each end of said envelope, said seal button having an aperture therethrough for receiving a niobium feedthrough member; a feedthrough member having an electrode projecting therefrom passing through said seal button aperture and being oriented such that the electrode projects into said tubular ceramic envelope, said feedthrough member being sealed into said seal button by means of a fritless seal between said seal button and said feedthrough; and sealing frit material sealing said seal buttons into the ends of said tubular ceramic envelope.

In accordance with another aspect of the present invention, there is provided a high pressure metal vapor discharge lamp comprising: an outer glass envelope having electrical conductors sealed therein and passing therethrough, each of said electrodes being in electrical connection with an electrical conductor; an arc tube mounted within said outer glass envelope, said arc tube comprising a tubular ceramic envelope, a chemical fill within said envelope; a seal button at each end of said envelope, said seal button having an aperture therethrough for receiving a niobium feedthrough member; a feedthrough member having an electrode projecting therefrom passing through said seal button aperture and being oriented such that the electrode projects into said tubular ceramic envelope, said feedthrough member being sealed into said seal button by means of a fritless seal between said seal button and said feedthrough; sealing frit material sealing said seal buttons into the ends of said tubular ceramic envelope; and a lamp base.

In accordance with another aspect of the present invention, there is provided a method for fabricating an arc tube for a high pressure metal vapor discharge lamp. The method comprises forming fritless seals between seal buttons and feedthrough members for each end of an arc tube envelope; permanently affixing an electrode to the feedthrough member of each fritless seal button/-feedthrough member assembly; sealing a first fritless seal button/feedthrough member assembly having the electrode attached thereto to one end of the arc tube envelope using frit material; depositing a chemical fill into the arc tube envelope sealed at one end; and sealing a second fritless seal button/feedthrough member assembly having the electrode attached thereto to the other end of the arc tube envelope using frit material.

For a better understanding of the present invention, together with other and further objects, advantages, and capabilities thereof, reference is made to the following disclosure and appended claims in connection with the above described drawings.

DETAILED DESCRIPTION

In accordance with the present invention, it has been found that the performance of arc tubes used in high pressure metal vapor discharge lamps is improved by eliminating a feedthrough member/frit material seal interface around the portion of the feedthrough member periphery which passes through the seal button aperture. The feedthrough member/frit material seal interface of a conventional ceramic arc tube typically extends from the point at which the feedthrough member projects into the arc tube to the point where the feedthrough member projects from the seal button to the exterior of the arc tube. Elimination of such continuous feedthrough member/frit material interface in high pressure metal vapor lamps, particularly those which operate with cold spot temperatures of at least 900° C., inhibits, and advantageously prevents, formation of a continuous path from the interior to the exterior of the arc tube through which fill gas contained in the arc tube can escape.

The present invention is directed to employing a brazeless, fritless hermetic seal between the ceramic seal button and feedthrough member of a ceramic arc tube assembly.

Figure 1:
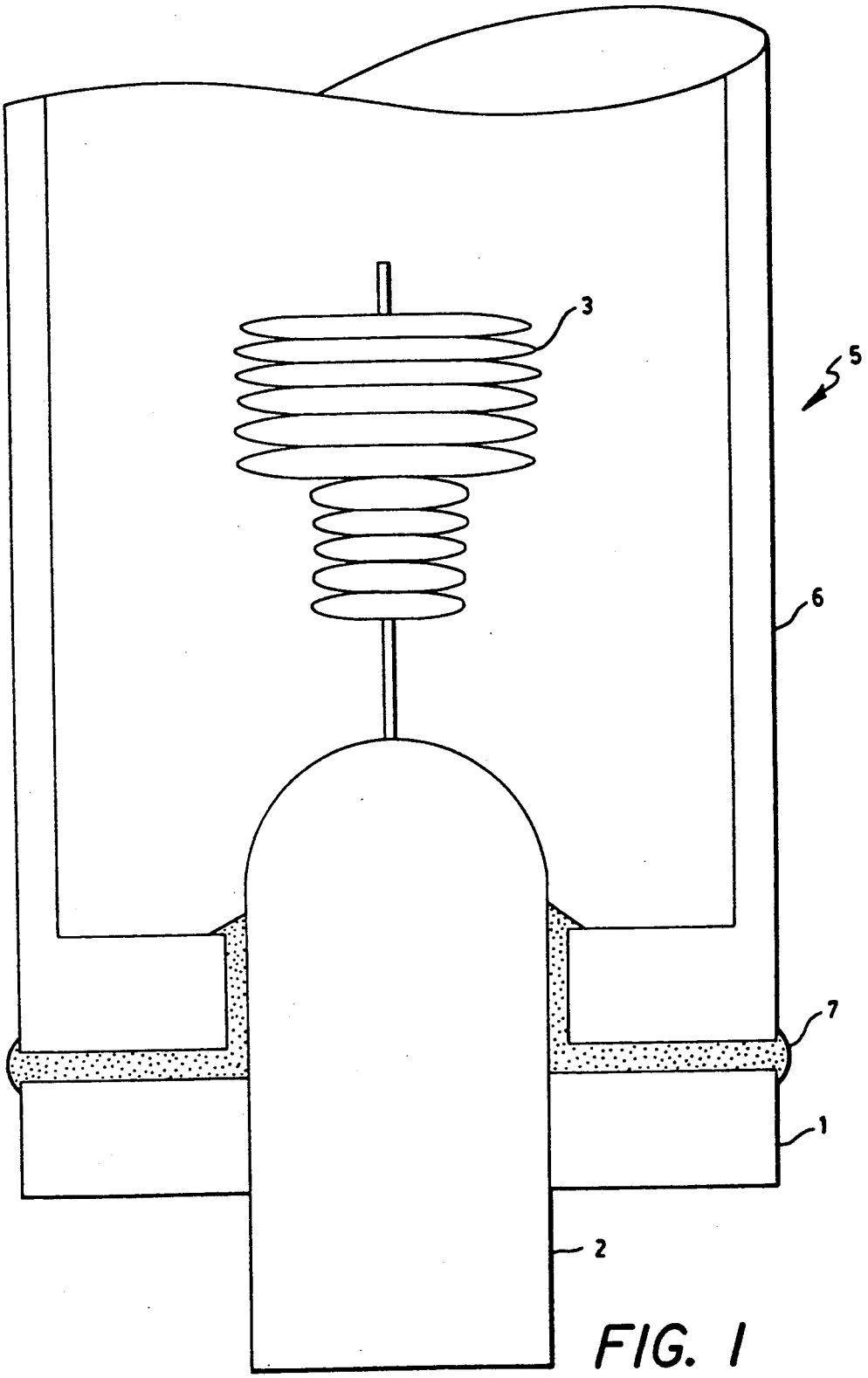
FIGS. 1-2 illustrate preferred embodiments of the end structures of arc tubes of the present invention.

With reference to FIG. 1, there is shown, in cross-section, the end structure of one embodiment of the present invention. The arc tube represented in FIG. 1 is of a monolithic design. In FIG. 1, a disk shaped seal button 1 is joined to the feedthrough member 2 by means of a fritless seal. An electrode 3 is attached to the feedthrough member 2 and projects into the interior of the arc tube 5. The seal button/feedthrough assembly is sealed to the arc tube envelope 6 by fused frit material 7.

Figure 2:
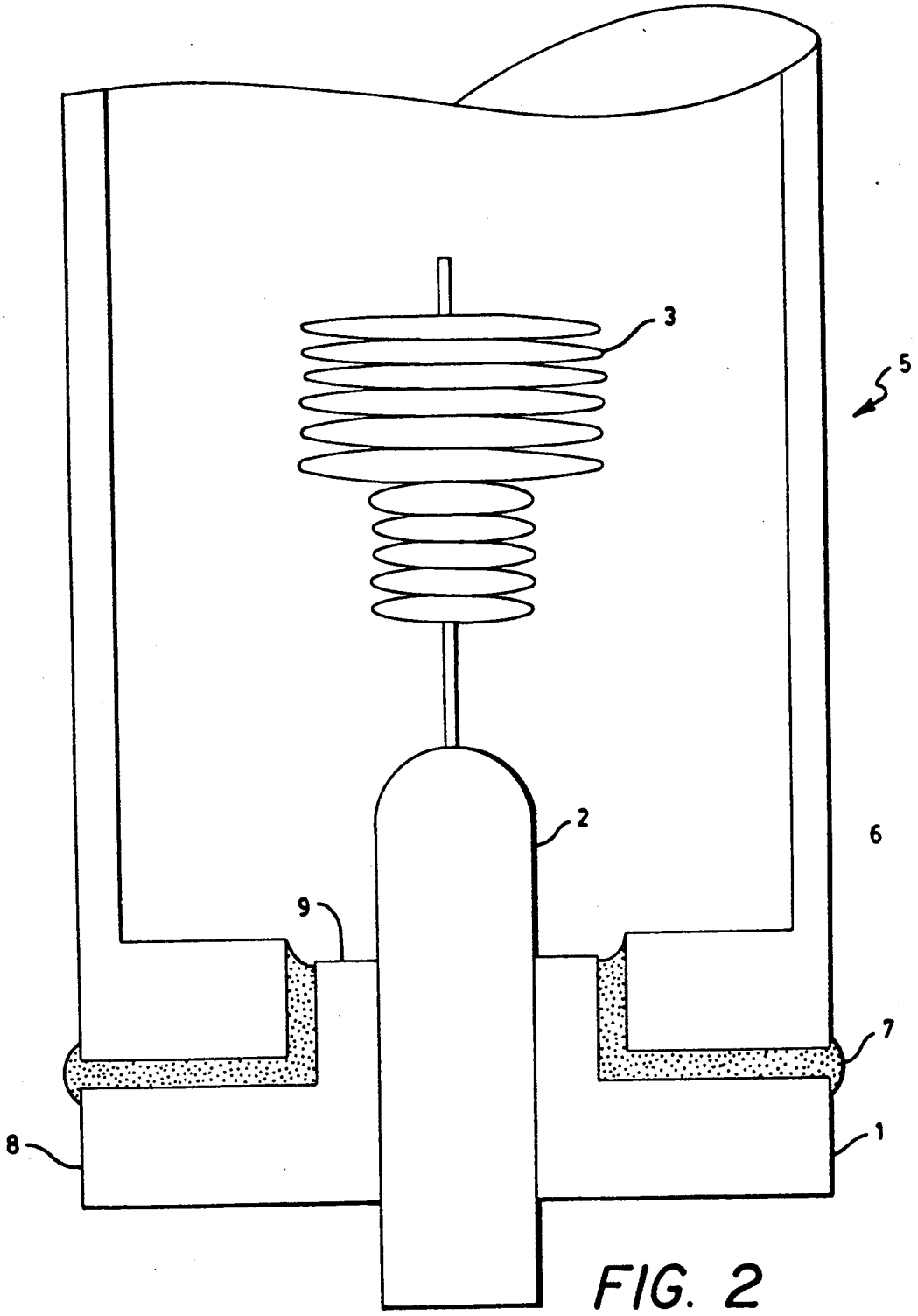
Figure 3:
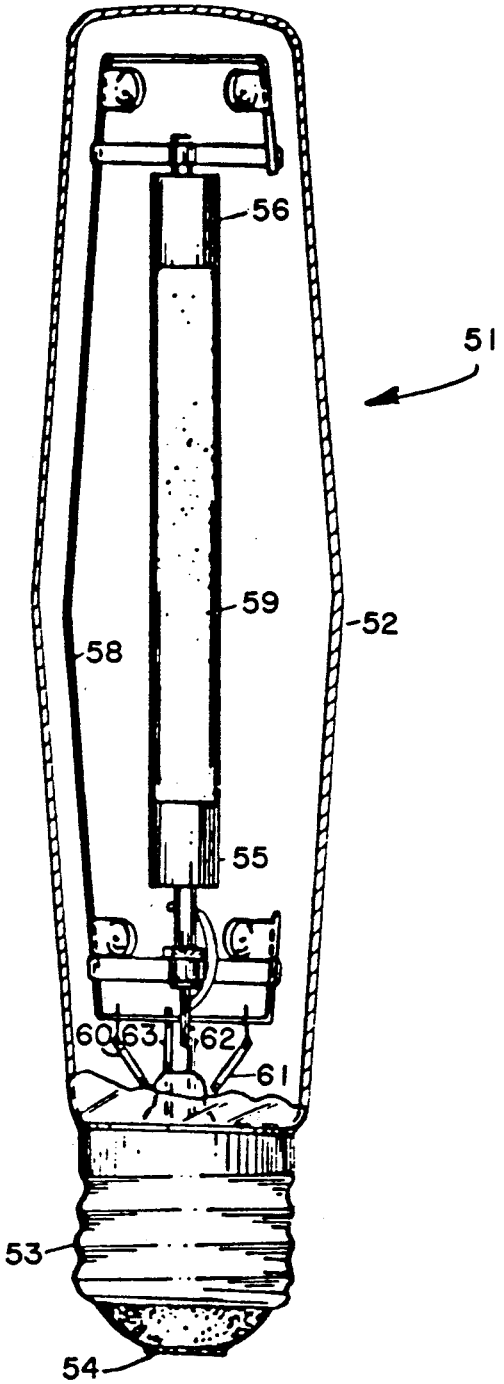
FIG. 3 illustrates an example of the structure of a high pressure metal vapor discharge lamp.

FIG. 2 illustrates, in cross-section, the end structure of an alternative embodiment of the present invention. The arc tube represented in FIG. 2 is of a hat design. In FIG. 2, a hat shaped seal button 1 is joined to the feedthrough member 2 by means of a fritless seal. An electrode 3 is attached to the feedthrough member 2 and projects into the interior of the arc tube 5. The seal button/feedthrough assembly is sealed to the arc tube envelope 6 by fused frit material 7.

In accordance with the method of the present invention, fritless seals are formed between the seal buttons and feedthrough members for each end of the arc tube envelope, an electrode is attached to the feedthrough member of each fritless seal button/feedthrough member assembly. One fritless seal button/feedthrough member assembly having the electrode attached thereto is sealed to the arc tube envelope using frit by known techniques. The fill material is then added to the arc tube, and the other fritless seal button/feedthrough member assembly having the electrode attached thereto is sealed to the arc tube envelope using frit material by known techniques.

The present invention represents a simplified fabrication procedure over that described in U.S. Pat. No. 4,545,799.

The present invention advantageously facilitates easy attachment of the electrode to the feedthrough member. The electrode can be attached to the feedthrough member following the fritless sealing of the feedthrough member to the seal button without having to insert and weld the electrode to feedthrough member by operating through the axial hole passing therethrough.

Additionally, the present invention permits the fill to be added to the arc tube after sealing one end of the arc tube and prior sealing the second end of the arc tube envelope.

The following represents an example of a preferred method for forming a fritless seal between the seal button and feedthrough member. Such preferred method for preparing fritless ceramic seal button/feedthrough member assemblies includes forming a cylindrical ceramic piece to the required green dimensions, calcining the ceramic to oxidize the binder and provide minimal strength, and then high firing to near maximum density. The green ceramic can be pressed to size or machined from a blank after isostatical pressing. The diameter of the hole into which the feedthrough member is placed is chosen to provide a predetermined interference to the free shrinkage of the ceramic. Determination of such interference is routine to one having ordinary skill in the art. The interference must be sufficiently large that the ceramic deforms and conforms to the metal but not so large as to excessively distort the shape of the end cap. The surface of the feedthrough member is most preferably free of grooves or unevenness to which the ceramic is unable to conform.

While the foregoing is representative of a preferred method for forming a fritless seal between the seal button and feedthrough member, alternative methods for forming such type of seal are known in the art and may be used instead.

EXAMPLE 1

The ceramic seal buttons used to seal each end of the arc tube were joined to feedthrough members by means of a fritless seal as shown in FIG. 1. The feedthrough members having 0.156" OD comprised niobium and 1 weight percent zirconium and had been roughly polished to remove major imperfections from the surfaces thereof. The ceramic seal buttons were isostatically pressed in the form of cigars, machined to size, and then calcined at 1350° C. to burn out the 1.5% polyvinyl alcohol and 0.5% carbowax additives which had been added to the ceramic powder as binders. The seal buttons were shrunk onto the feedthrough members by firing 15 minutes at 1830°-1840° C. in purified argon. The final dimensions of the buttons were 0.34" OD and 0.15" thickness. The interference of the feedthrough member with free shrinkage of the button hole was chosen to be 4%, 7%, or 10% of the green hole diameter (i.e., the hole diameter would have closed by an additional 0.008", 0.014", or 0.020" if the inlead had not been present). The fired composition (designated type D) of the seal buttons comprise alumina, 1.7% percent yttria, and 0.05% magnesia. added originally as nitrates prior to spray drying, so as to produce a significant amount of liquid phase during sintering of the button.

Fritless seal button/feedthrough assemblies were sealed to both ends of four 0.350" OD arc tubes with PF frit in the standard manner. (As used herein "PF frit" refers to a sealing frit material comprising, prior to sealing, 45.6% $Al_2O_3$, 39.0% CaO, 8.6% BaO, 5.2% MgO, and 1.6% $B_2O_3$.) The arc tube fill was 150 mg Tl, 30 mg Cd, and 150 torr of argon. The arc tubes were placed inside evacuated quartz tubes and heated in a tube furnace so that the seals were maintained at 945°-955° C. No leakage of fill was observed during the 1375 hours at temperature. Four controls were run the same way, but having the buttons joined to the inlead with PF frit, began to leak fill at an average of 120 hours and lost all their fill well before 1000 hours.

EXAMPLE 2

Hat type seal buttons, as shown in FIG. 2, comprising a disk portion 8 and sleeve portion 9 (also referred to herein as sleeve) were joined to polished Nb/1% Zr inleads of 0.085" or 0.123" OD or Nb wire of 0.040" diameter. The seal buttons were first calcined at 1250° C. for 5 hours in air and then shrunk onto the inleads by firing 20 minutes at 1860° C. in purified argon. All of the seal buttons had 0.05" sleeves and button thickness of either 0.06" or 0.17". The interference on the inlead ranged from 1% to 10%. The seal buttons were made not only with type D formulation but also with a high alumina composition (designated type A) containing less than 0.1% oxides as sintering aids and grain growth inhibitors. The fired seal button contained 0.05% magnesia and 0.02% yttria. Allowance was made for the different shrinkage of composition types D and A.

The fritless seal button/feedthrough member assemblies having electrodes attached to the feedthrough members were sealed to each end of eight 0.350" OD arc tubes with PF frit and a fill of 150 mg Tl, 30 mg Cd, and 20 torr of argon. The completed arc tubes were heated as in Example 1, except that the seal temperature was 1020° C. Four tubes went 2290 hours and four were held 3220 hours without any sign of leakage. A control tube at this same temperature began to leak its fill at 40 hours.

EXAMPLE 3

Six lamps were made with fritless joined seal buttons as shown in FIG. 2. The seal buttons used in this set of experiments were fabricated from the aforementioned type D composition. The dimensions of the seal buttons after firing were 0.51" OD by 0.21" thick. Three pairs of buttons had 3% interference and three had 6% interference on the Nb/1% Zr feedthrough member. The three pairs of seal buttons with 3% interference were treated as one group, and the three pairs of seal buttons with 6% interference were treated as a second group. The feedthrough members which were used with two of the pairs of seal buttons in each group were polished to remove surface roughness. The feedthrough members used with the other pair of seal buttons of each group were used as manufactured. Each arc tube had a fill of 0.48 mg Na, 11.0 mg Hg, 15.4 mg Cd, 82.0 mg Tl, and a starting pressure of 30 torr Xe. The PCA arc tubes, of 0.405" ID, 0.485" OD, and 2.24" cavity length, were sealed to the fritless seal button/feedthrough member assemblies using PF frit and a standard frit sealing procedure. The lamps were run at 250 W and the end of the arc tubes were insulated so that temperatures were in the 950°-1000° C. range.

None of the six lamps showed any signs of leakage of fill after 4400 hours of operation with two on/off cycles per day. In contrast, lamps otherwise made the same way but with a fritted seal between the seal button and feedthrough member invariably began to leak by 1000 hours.

EXAMPLE 4

Seven lamps were fabricated following a procedure similar to that described in Example 3, but using different interferences or materials for the buttons and only 0.3 mg of Na in the fill. Two lamps were made with D type material and 1% interference, two lamps with D material and 11% interference, and three lamps with A type material and 2% interference. The 11% interference caused a bulge in the button, which was then ground flat for sealing to the arc tube. These lamps have lasted 1500 hours without any leakage of fill from arc tube to the outer jacket.

EXAMPLE 5

A lamp was made using hat seal buttons fabricated from the aforementioned type D composition. These seal buttons were joined to 0.085" feedthrough members. Seal buttons having a length of 0.11" were used. These seal button sleeves stopped short of the weld between feedthrough member and the tungsten rod supporting the electrode. This lamp lasted over 1000 hours without leakage, whereas a control lamp with fritted seal button/feedthrough member seal lost sufficient fill by 500 hours to plate the jacket of the lamp with an opaque metallic film.

When seal buttons are used with longer sleeves, the sleeve has a tendency to develop radial cracks which lead to early failures. Short sleeves, such as were used in Example 2 present no problems. Care must be taken when the sleeve is longer as in this example. Resistance to cracking was shown by many experiments to be a function of sleeve diameter, feedthrough member diameter, sleeve length, and feedthrough member straightness. Ideally the sleeve should have a thick aspect ratio and small interference on the feedthrough member.

Other geometries which also employ direct (or fritless) bonding of a seal button to the feedthrough member and fritting of this assembly to the arc tube would be considered within the teaching of the present invention. An example of this is the fritless sealing of a disk shaped seal button to a feedthrough member, which fritless assembly is sealed with frit material directly into a straight arc tube. This teaching would also apply to sealing of such an assembly to any ceramic piece for the Purpose of making a hermetic feedthrough.

The ceramic seal button used in the present invention is preferably composed of material resistant to reaction with the feedthrough member, in particular, reduction of any of its components, so that fill does not have a pathway along the feedthrough member surface to the exterior.

The arc tube of the present invention can be used in high pressure metal vapor discharge lamps of the high pressure sodium type, or of the high pressure mixed metal vapor type. The details of the construction of these various types of lamps are well known to the artisan having ordinary skill in the lighting art.

FIG. 4 illustrates an example of a high pressure metal vapor discharge lamp of the high pressure sodium type to which the invention is applicable. The lamp 51 comprises an arc tube 59 supported within an evacuated outer vitreous glass envelope 52, for example, borosilicate glass, having means for electrically coupling the lamp with a power source (not shown), such as a lamp base 53 with a terminal 54. Electrical conductors 62, 63 are sealed within and pass through the outer envelope to provide electrical connections from the interior to the exterior of the glass envelope. The arc tube 59 containing a fill comprising sodium, mercury, and a rare gas is supported within the outer envelope 52 by support means 58 such as a a metallic frame in a well known manner. The rare gas acts as a starting gas and the mercury acts as a buffer gas to raise the gas pressure and operating voltage of the lamp to a practical level. Heat conserving means 55, 56, may be wrapped about the arc tube 59 at each end thereof in the vicinity of the electrodes (not shown), in order to reduce the heat differential thereat from the center of the arc tube.

Each end of the arc tube includes a fritless seal between the seal button and the feedthrough member according to the present invention.

The seal between the fritless seal button/feedthrough member assembly having an electrode attached to the feedthrough member is formed from seal means comprising fused seal material, such as melted (or fused) glass ceramic frit.

The sealing frit material can be any of the sealing frit materials typically used in the fabrication of arc tubes for high pressure sodium vapor discharge lamps, such as, for example, an alkaline-earth based seal material including $Al_2O_3$, CaO and BaO with replacements or additions of SrO, $Y_2O_3$, $La_2O_3$, MgO, and/or $B_2O_3$.

A high pressure metal vapor discharge lamp in accordance with an embodiment of the present invention may be of a saturated or unsaturated vapor type. The amounts of sodium and mercury required to dose either saturated or unsaturated type high pressure sodium lamps are known to those skilled in the art.

Most high pressure metal vapor discharge lamps can operate in any position. The burning position has no significant effect on light outputs. A high pressure sodium discharge lamp may further include diffuse coatings on the inside of the outer bulb to increase source luminous size or reduce source luminance. The outer envelope may further include getters, 60, 61.

While there has been shown and described what are considered preferred embodiments of the present invention, it will be obvious to those skilled in the art that various changes and modifications may be made therein without departing from the invention as defined by the appended claims.

What is claimed is:

1. A method for fabricating an arc tube for a high pressure metal vapor discharge lamp, said method comprising:

forming fritless seals between ceramic seal buttons and feedthrough members for each end of an arc tube envelope;

permanently affixing an electrode to the feedthrough member of each fritless ceramic seal button/feedthrough member assembly;

sealing a first fritless ceramic seal button/feedthrough member assembly having the electrode attached thereto to one end of the ceramic arc tube envelope using frit material;

depositing a chemical fill into the ceramic arc tube envelope sealed at one end; and sealing a second fritless ceramic seal button/feedthrough member assembly having the electrode attached thereto to the other end of the ceramic arc tube envelope using frit material.

* * * * *